US005467179A

United States Patent [19]

Boeck et al.

[11] Patent Number: 5,467,179

[45] Date of Patent: Nov. 14, 1995

[54] TURNOVER DEVICE FOR A WEB-SHAPED RECORDING MEDIUM

[75] Inventors: Vilmar Boeck, Poing; Peter-Paul Kalhoff, Munich, both of Germany

[73] Assignee: Siemens Nixdorf Informationssysteme AG, Paderborn, Germany

[21] Appl. No.: 185,241

[22] Filed: Jan. 24, 1994

[30] Foreign Application Priority Data

Oct. 18, 1993 [DE] Germany ..... 43 35 473.4

[51] Int. Cl.[6] ..... G03G 21/00; B41F 13/02; B65H 23/32

[52] U.S. Cl. ..... 355/309; 101/223; 226/197; 271/184; 271/225; 355/318

[58] Field of Search ..... 355/309, 312, 355/318, 319; 226/197, 199; 271/184, 185, 186, 225; 101/223

[56] References Cited

U.S. PATENT DOCUMENTS

| | | | |
|---|---|---|---|
| 300,162 | 6/1884 | Taylor | 101/223 |
| 3,206,089 | 9/1965 | Huck | 226/197 X |
| 3,542,621 | 11/1970 | Calhoun, Jr. et al. | 226/197 X |
| 3,548,783 | 12/1970 | Knapp | 355/318 X |
| 3,906,855 | 9/1975 | Laursen | 101/223 |
| 4,610,198 | 9/1986 | Raymond | 101/223 |
| 4,863,087 | 9/1989 | Kohler | 226/197 |

FOREIGN PATENT DOCUMENTS

| | | |
|---|---|---|
| 0342491 | 11/1989 | European Pat. Off. . |
| 1039539 | 9/1958 | Germany . |
| 2001866 | 7/1971 | Germany . |
| 3816900 | 11/1989 | Germany . |
| 91051851 | 10/1992 | Germany . |
| 1127 | 3/1875 | United Kingdom . |
| WO92/15513 | 9/1992 | WIPO . |

*Primary Examiner*—A. T. Grimley
*Assistant Examiner*—Nestor R. Ramirez
*Attorney, Agent, or Firm*—Hill, Steadman & Simpson

[57] ABSTRACT

A turnover device for turning a web-shaped recording medium over between two electrographic printer or copier devices working in tandem mode, the crossing point of the turning elements is arranged offset a distance $\pi r/\sqrt{2}$ in the direction of the deflector element relative to the middle of the supplied recording medium, taking the cross sectional dimensions of the turning elements into consideration. A lateral offset of the recording medium is thereby avoided.

14 Claims, 5 Drawing Sheets

TURNOVER DEVICE FOR A WEB-SHAPED RECORDING MEDIUM

BACKGROUND OF THE INVENTION

The invention is directed to a turnover device for turning a web-shaped recording medium over. The invention is particularly advantageous arranged between two electrographic printer or copier devices working in tandem mode.

Such a turnover device is disclosed, for example, by WO 92/15513. It serves the purpose of turning the paper web over between two printer devices operating in tandem mode in order, for example, to thus enable duplex printing.

What is disadvantageous about the known turnover device is its broad structure and the offsetting of the paper web that prevents an aligned arrangement of the two printers participating in the printing.

An aligning arrangement of the printers, however, is beneficial when the printers are also used without a turnover device for printing a paper web on one side, for example with two superimposed images. In order to avoid imprecisions in the paper running, a straight: line guidance with a paper web between the printers is necessary in this operating mode. When papers webs of different widths are employed, one side edge serves as a firmly prescribed reference edge in the paper channel. In this case, too, it is necessary to align the printers according to this reference edge. Realigning the printers every time dependent on the operating mode is complicated and time-consuming and is hardly possible given electrographic high-performance printers that are permanently installed.

When web-shaped materials are deflected with drums, rollers or rods residing obliquely relative to the conveying direction, the diameters or, respectively, cross sections of these deflector parts also enter into the lay of the web position. This effect especially gains significance when the recording medium is deflected by a plurality of such deflector parts as, for example, given the crossed turners having two crossed turnover elements and a lateral deflector element as disclosed by U.S. Pat. No. 3,206,089. When the web guidance is defined, for example, in tandem printing at the input and output side of the printers and cannot be modified due to the employment of a turnover device, the position of the material web should be independent of the influence of the turnover device.

SUMMARY OF THE INVENTION

It is therefore an object of the invention to offer a compact turnover device of the species initially cited, whereby an offset of the recording medium does not occur, and which enables the employment of recording mediums having different widths.

A further goal of the invention is to fashion the turnover device low-friction.

In a turnover device of the species initially cited, this object is achieved wherein two crossed turning elements and a deflector element arranged laterally with respect thereto are provided; the recording medium is supplied to the turning elements in a prescribed delivery attitude aligned at a first lateral edge; and the crossing point of the turning elements is arranged offset in the direction of the deflector element, taking the cross sectional dimensions of the turning elements relative to the middle of the supplied recording medium into consideration, such that the recording medium departs the turnover device in a turned attitude wherein its other, second lateral edge aligns with this first lateral edge.

When the crossing point of the obliquely residing turning elements relative to the center of the web of the recording medium is shifted by an amount that is dependent on the cross sectional dimensions of these parts, an offset of the recording medium when passing through the turnover device does not occur. The incoming and outgoing recording medium has a straight-lined edge, aligning the course. Given circular cross sections of the elements, the offset of the crossing point relative to the web center required for compensation amounts to $(\pi/\sqrt{2})r$, where r=radius of the elements.

When recording media having different widths but with a fixed reference edge are employed, the turnover device must be fashioned transversely displaceable relative to the recording medium web.

The turnover device can provide guide rollers that are arranged at the input side and output side relative to the turning elements and which accept the recording medium.

In order to reduce the frictional drag, particularly when employing stiff materials, it is advantageous to produce an air cushion between recording medium and the deflector elements in the region of the deflection points. This preferably occurs via air exit openings that expand in the direction of the recording medium. As a result thereof, air chambers are produced that sill maintain an air pillow even given elevated tensile forces in the web material.

The turning elements and/or a deflector element can be fashioned as stationary elements.

Air delivery can be through the elements fashioned as hollow elements via their mechanical connecting points.

The turnover device can be arranged both horizontally as well as vertically between the printers. A horizontal arrangement is particularly suitable for heavy but flexurally slack web materials such as, for example, textiles or heavy papers. These are thereby supported and a dipping of the web in stand still, which could cause difficulties in the web guidance in the following start-up, is prevented.

The turnover device is compactly constructed and flexibly employable. It is particularly suitable for tandem operation with high-performance printers having a printing capacity of up to 200 sheets per minute and above.

Embodiments of the invention are shown in the drawings and shall be set forth in greater detail by way of example below.

DETAILED DESCRIPTION OF THE PREFERRED EMBODIMENTS

A tandem printer means composed of a two coupled, electro photographic high-performance printers is disclosed, for example, by WO 92/15513 contains a turnover for turning the recording medium over in the form of a crossed turner.

Figure 1:
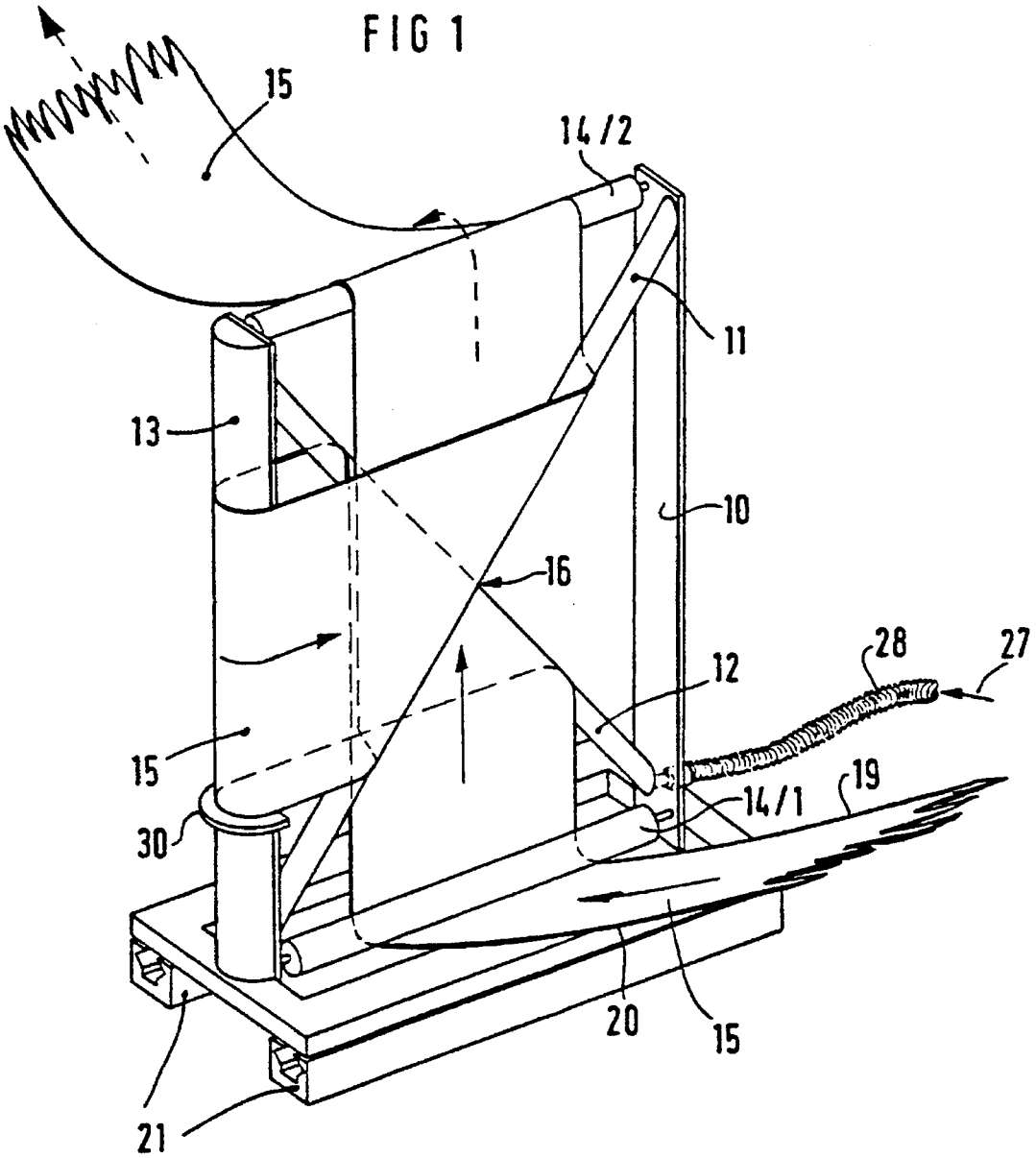
FIG. 1 is a perspective view of a turnover device with integrated air guidance fashioned as a crossed turner.
Figure 2:
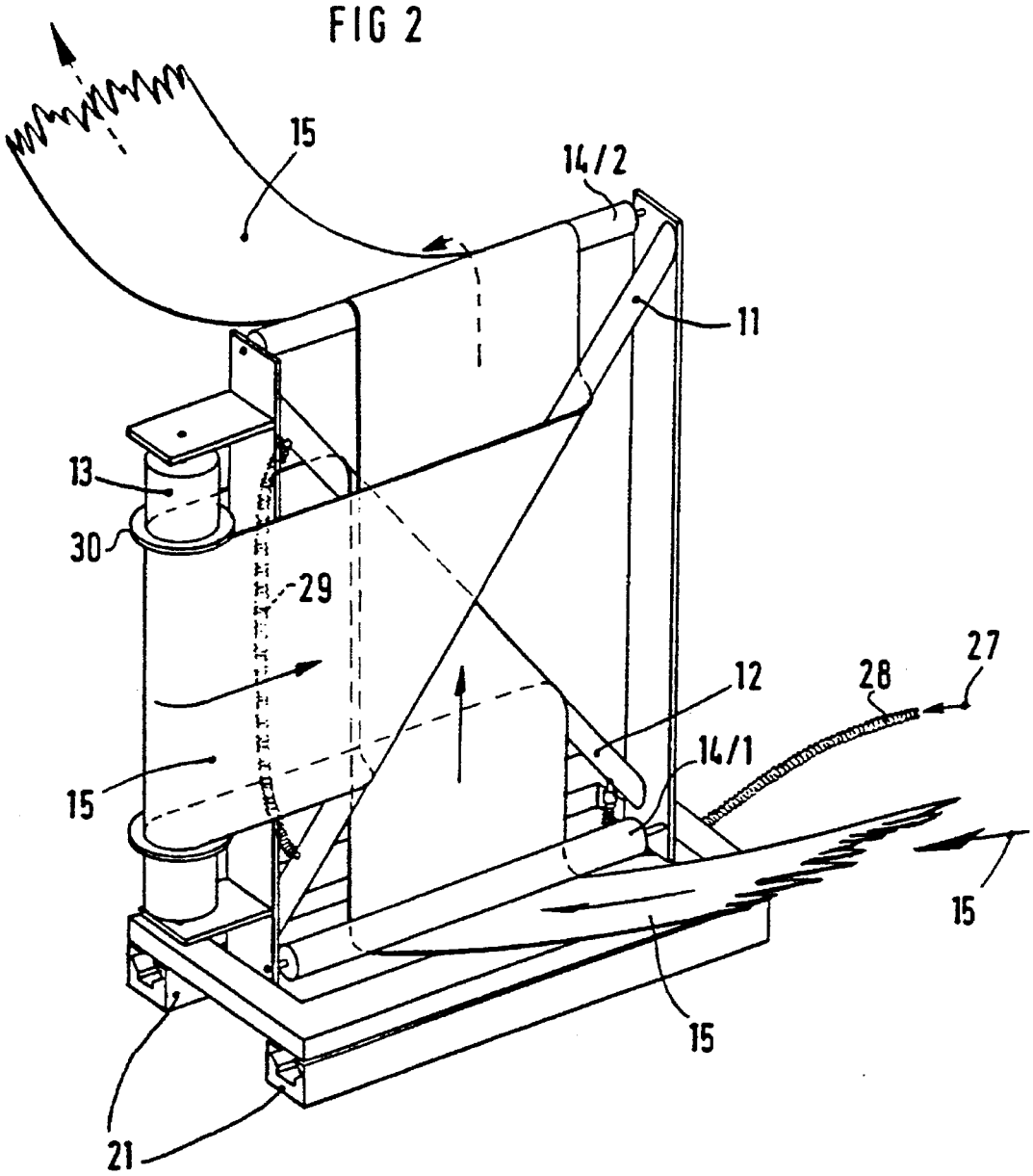
FIG. 2 is a perspective view of a turnover device having a drum as deflector element and fashioned as a crossed turner.

A turning unit can be provided per FIGS. 1 and 2 having two turning elements 11 and 12 arranged crossed in a frame 10 and of a deflector element 13 arranged laterally relative thereto. The turning unit also provides respective, rotatably seated paper guidance rollers 14/1 and 14/2 in its delivery region and in its exit region. The entire turning unit serves the purpose of turning a recording medium 15 in the form of a paper web supplied via the paper guidance roller 14/1 by 180°.

Figure 3:
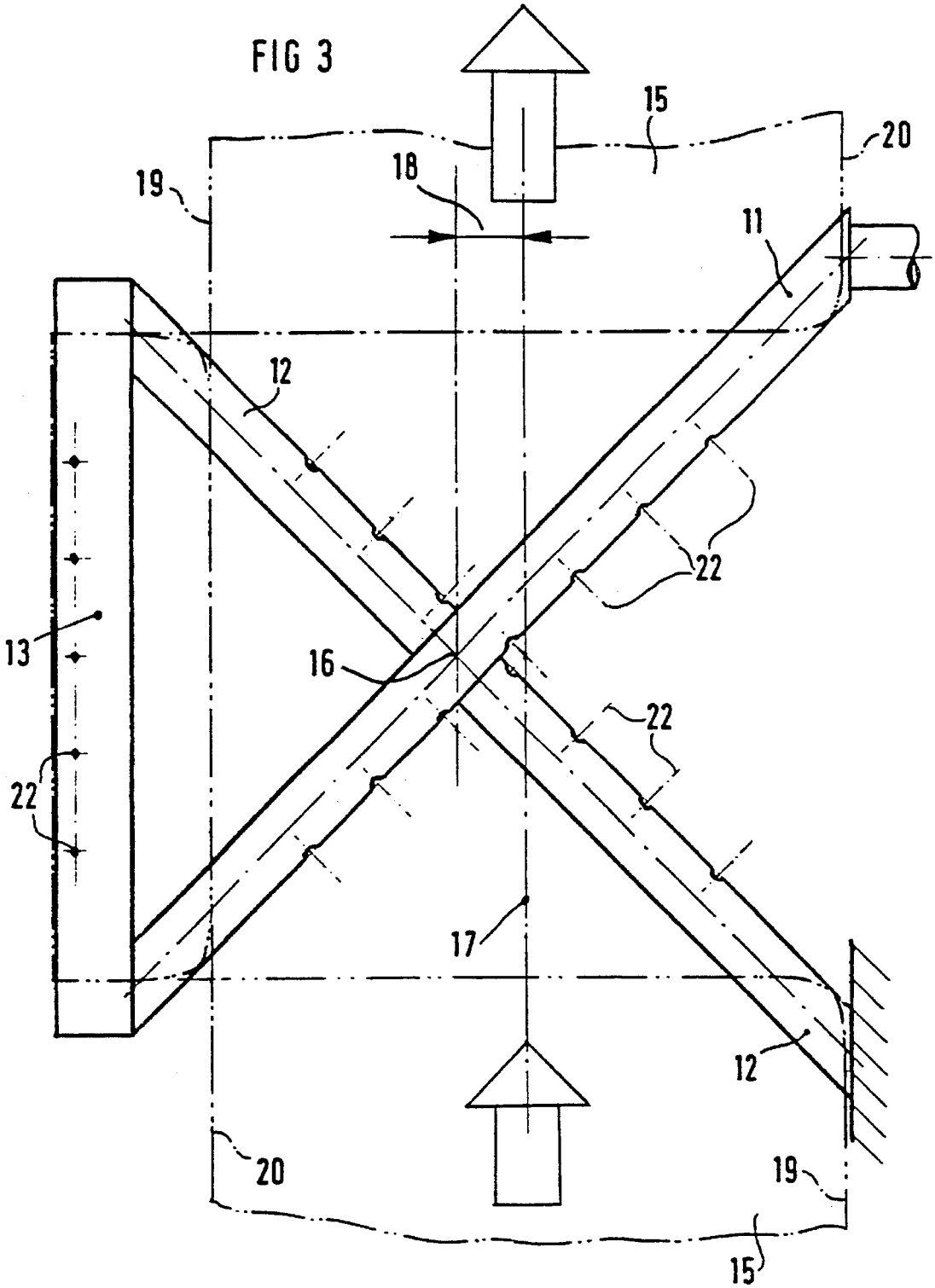
FIG. 3 is a schematic illustration of the critical function elements of the turnover device and of the position of the recording medium relative to the crossing point in the turnover device.

In accord with the illustration of FIG. 3, web-shaped materials are deflected via turning elements residing obliquely relative to the conveying direction of the materials and which, for example, can be fashioned as obliquely residing drums, rollers or rods. The diameters or cross sections of these deflector parts 11 and 12 also influence the lay or location of the web position. This effect particularly gains significance when a prescribed web guidance can only be effected by a plurality of such deflector parts. When the web guidance is defined at the input side as well as at the output side and cannot be changed by the turnover device, i.e., when the position of the material web, for example of the recording medium should be independent of the presence or absence of the turnover device and must be exactly located, the required deflections must then be arranged so that their influence is compensated. This is achieved in that the crossing point 16 of the obliquely residing turning elements 11 and 12 is shifted by a distance 18 in the direction of the deflector element 13 relative to the center 17 of the web of the recording medium 15. This distance 18 is dependent on the cross sectional dimensions of these turning elements 11 and 12.

When, as in the exemplary embodiments, rod-shaped elements having a circular cross section are employed as turning elements 11 and 12, the crossing point 16 must be distanced from the center 17 of the web by $\pi r/\sqrt{2}$, whereby the radius of the turning elements 11 and 12 is referenced with "r". The displacement direction is prescribed by the direction of the deflected recording medium, whereby the oblique deflector element yields, so to speak, to the web material due to the offset 18.

As a result of such a dislocation of the crossing point 16, the recording medium 15 is not offset by the turnover device; rather, a straight-line, aligning course of the recording medium 15 at the input side and output side is provided. When, for example, the right-hand limiting edge 19 of the entering recording medium 15 is defined as reference edge, then the recording medium is turned in the turnover device such that it departs the turning unit in a turned attitude wherein its other, left-hand edge 20 aligns with this reference edge 19.

The recording medium 15 is mirrored symmetrically to the center axis of the turning unit by the turning unit and not symmetrically relative to the crossing point 16. This means that a web entering at the left from the center axis departs a turning unit correspondingly offset toward the right. When recording media having different widths are employed, all of these, however, being aligned with respect to a fixed reference edge 19, however, the position of the turning unit must be respectively set to the middle 17 of the recording medium 15 dependent on the width of the recording medium.

According to the exemplary embodiments of FIGS. 1 and 2, the turning unit is seated on guides 21 transversely displaceable relative to the conveying direction of the recording medium 15 for transverse movement of the turning unit. The transverse displacement and, thus, the positioning of the turning unit to the center of the recording medium can ensue manually or can ensue automatically with the assistance of a positioning device. In the automatic positioning, the positioning device contains, for example, two elements that sense the web edges 19 and 20 of the recording medium 15 and contains an electromotive adjustment device that, under microprocessor control, displaces the turning unit on the guides 21 under electromotive drive dependent on the sensing event. The crossing point 16 must thereby always be positioned relative to the web middle 17 with the fixed offset 18 dependent on the cross sectional dimensions of the turning elements 11 and 12.

The deflection of stiff materials produces an increase in the frictional forces at the deflector parts. The material spectrum of recording media that can be processed is thereby limited. Passive measures such as, for example, a corresponding surface treatment of the turning and deflecting elements by polishing, etc., and by enlarging the cross sectional dimensions given stationary deflector parts, can be undertaken in order to reduce friction. In the illustrated exemplary embodiments, an air cushion is produced between the recording medium 15 and the elements in the deflection region of the turning elements 11 and 12 and of the deflector element 13, as an active measure. To this end, the turning elements 11 and 12 and, in the case of the exemplary embodiment of FIG. 1 having a stationary deflector element 13, contain air exit openings 22 at their circumference in the deflection region. The air exit openings 22 having the stationary deflector parts 11, 12 and 13 are located in the wrap region of the recording medium 15 and over approximately 60% of the width of the recording medium 15 symmetrically relative to the middle thereof.

It is advantageous to select the cross section of the air exit openings such that it preferably expands in the direction of the outside diameter of the deflector part or, respectively, in the direction to the web material. As a result thereof, air chambers are produced that maintain an air cushion between recording medium 15 under the deflector parts even given an elevated tensile force in the recording medium 15.

Figure 4:
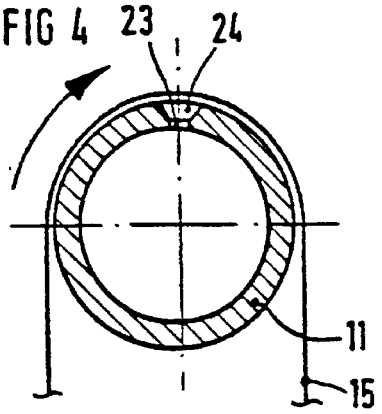
FIG. 4 is a sectional view of an embodiment of a turning element and an air exit opening, taken generally along line IV—IV of FIG. 5.
Figure 6:
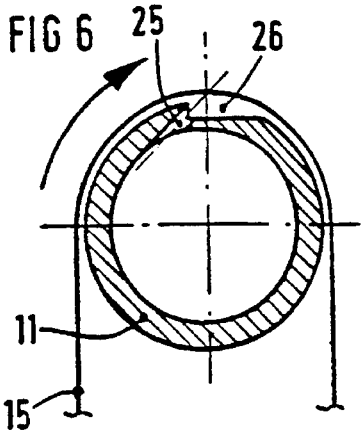
FIG. 6 is a sectional view of an embodiment of a turning element and an exit opening, taken generally along line VI—VI of FIG. 7.
Figure 5:
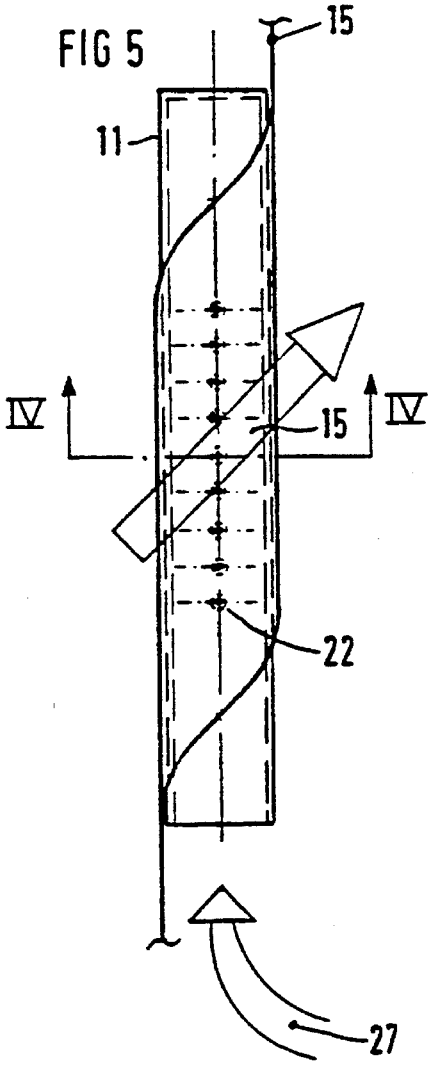
FIG. 5 is an elevational view of the turning element of FIG. 4.
Figure 7:
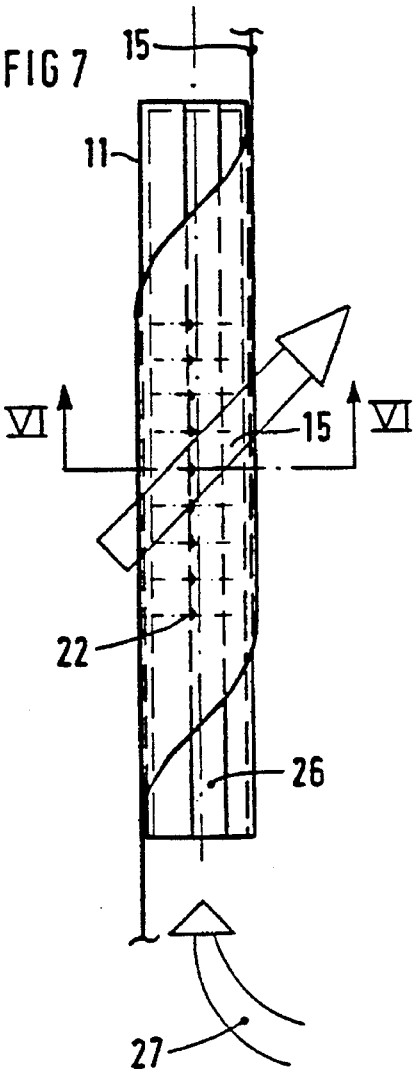
FIG. 7 is an elevational view of the turning element of FIG. 6.

In the exemplary embodiment of FIGS. 4 and 5, air exit openings are composed of a delivery opening 23 having a funnel-shaped expansion 24 extending therefrom. In the exemplary embodiment of FIGS. 6 and 7, air exit openings are composed of an oblique bore 25 as delivery opening that proceeds approximately tangentially relative to the moving direction of the recording medium 15 and of an air cushion region that is expanded step-like in cross section. The moving direction of the recording medium 15 is identified by arrows in the cross sectional view of FIGS. 4 and 6. The air 27 is supplied to the air exit openings via the turning elements 11 and 12 themselves, which are fashioned as tubes closed at one end for this purpose in accord with the illustration of FIGS. 5 and 7.

When, according to the illustration of FIG. 1, both the turning elements 11 and 12 as well as the deflector element 13 are fashioned as stationary, hollow deflector parts, then the air can be supplied to the deflector parts 11, 12 and 13 via their botanical connecting points. To this end, the turning element 11 comprises a hose delivery 28 at its lower projection. The turning element 12 has its other end in communication with the deflector element 13 and the latter is in turn connected to the turning element 11 that is connected air-tight to the frame 10.

The deflector element 13 is fashioned as a rotatable drum in the exemplary embodiment of FIG. 2. In this case, it is necessary to connect the turning elements 11 and 12 via an additional hose conduit, 29.

In order to prevent the recording medium from sliding off on the deflector element 13, guides 30 are arranged on the deflector element 13.

Figure 8:
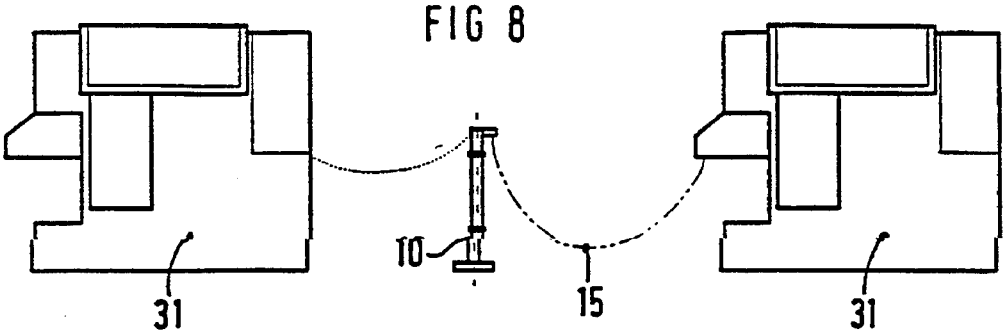
FIG. 8 is a schematic side view of a tandem printer arrangement having vertically placed turnover device.
Figure 9:
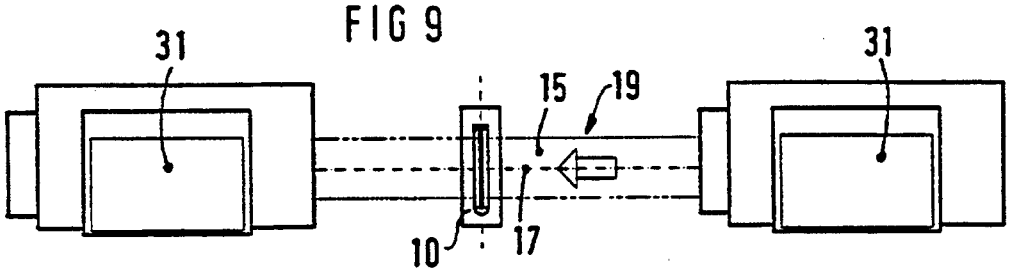
FIG. 9 is a schematic view of a tandem printer arrangement from above with a vertically placed turnover device.
Figure 10:
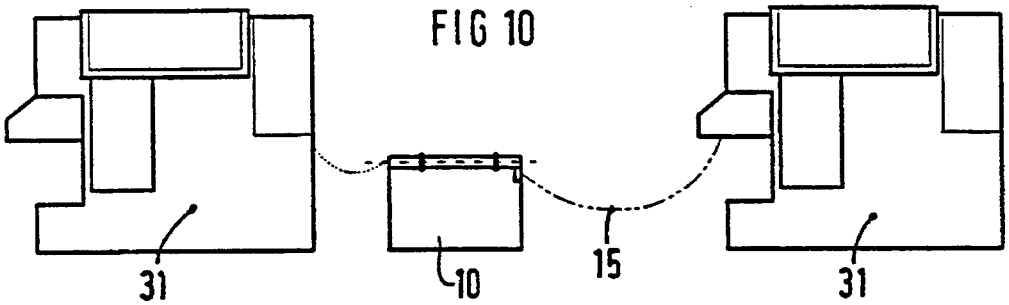
FIG. 10 is a schematic side view of a tandem printer arrangement having a horizontally placed turnover device.
Figure 11:
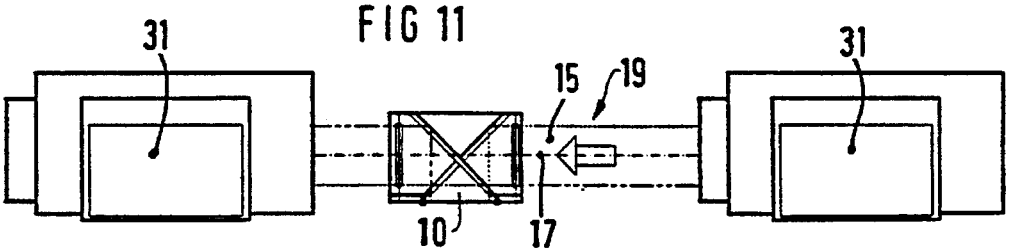
FIG. 11 is a schematic view of a tandem printer arrangement from above with a horizontally placed turnover device.

The turnover device which has been set forth can be placed both vertically as well as horizontally between the printer edges participating in the tandem mode of printers 31/31. A vertical placement corresponding to FIGS. 8 and 9 is especially space-saving. A horizontal placement according to FIGS. 10 and 11 is particularly suitable for heavy but flexurally slack web materials such as, for example, textiles and heavy paper webs. What is thereby avoided in standstill or, respectively, in the intermittent operation of the tandem printer arrangement is that the web material drops down in the turnover device and causes difficulties in the web guidance in the following, renewed start-up.

For turning the recording medium within the turnover device, the recording medium 15 is first supplied to the obliquely residing turning element 12 via the paper guidance roller 14/1 at the input side, is deflected by this turning element 12 by 90° and is supplied via the deflector element 13 to the second obliquely residing turning element 11. Here, too, a 90° deflection ensues and the recording medium departs the turnover device in its turned-over condition guided via the paper guidance roller 14/2 of the output side. In the illustration of FIGS. 1 and 2, the moving direction arrows entered with solid lines indicate the front side of the recording medium and the arrows shown with broken lines indicate the backside thereof.

Although the present invention has been described with reference to a specific embodiment, those of skill in the art will recognize that changes may be made thereto without departing from the scope and spirit of the invention as set forth in the appended claims.

We claim as our invention:

1. A turnover device for turning a web-shaped recording medium having a first and second lateral edge, said medium supplied to the turnover device in a prescribed delivery attitude, comprising:

two crossed turning elements and a deflector element arranged laterally with respect thereto; and a crossing point of the turning elements is arranged offset in the direction of the deflector element, such that the recording medium departs the turnover device in a turned attitude wherein said second lateral edge aligns with said first lateral edge; and wherein said turning elements have a circular cross section with a prescribed radius r, the crossing point of said turning elements being arranged offset from the center line of the recording medium corresponding to a distance of $\pi r/\sqrt{2}$.

2. A turnover device according to claim 1 further comprising guides, said turning elements and said deflector element arranged on said guides transversely displaceable relative to the recording medium.

3. A turnover device according to claim 1 further comprising guide rollers that are arranged at the input side and output side relative to the turning elements and accept the recording medium.

4. A turnover device according to claim 1, comprising air exit openings as a means for producing an air cushion, arranged in the deflector element.

5. A turnover device according to claim 1, comprising air exit openings as a means for producing an air cushion, arranged in at least one of the turning elements.

6. A turnover device according to claim 5, whereby the air exit openings comprise a cross sectional shape that expands in the direction toward the wrapping recording medium.

7. A turnover device according to claim 1, wherein said turning elements and said deflector element are fashioned as stationary elements.

8. A turnover device according to claim 7, comprising an air delivery through the turning and deflector elements via their mechanical connecting points and at least one of said turning and deflector elements comprise air exit openings for producing an air cushion between said at least one and said medium.

9. A turnover device according to claim 1, wherein the turning elements and the deflector element are arranged in a plane that proceeds vertically relative to the conveying direction of the recording medium.

10. A turnover device according to claim 1, wherein the turning elements and the deflector element are arranged in a plane proceeding in conveying direction of the recording medium.

11. A turnover device according to claim 1 which is fashioned as a mobile structural unit.

12. A method of turning over a web-shaped recording medium, comprising the steps of:

providing a first turning element, a second turning element and a deflector element;

arranging the first and second turning elements crossed;

arranging the deflector element laterally of the crossed turning elements;

circulating the web-shaped recording medium partially around the first turning element, then partially around the deflector element, then partially around the second turning element;

arranging the crossing point of the first and second turning elements offset from a centerline of said medium toward said deflector element; and wherein said step of providing first and second turning elements is further defined as providing circular cross section turning elements having radius "r"; and said step of arranging the crossing point is further defined as offsetting said crossing point a distance of $\pi r/\sqrt{2}$ from the centerline of the recording medium.

13. The method according to claim 12 comprising the further step of:

providing an air cushion between the turning elements and the medium.

14. The method according to claim 12 comprising the further steps of:

arranging the turning elements and deflector element to be laterally selectively displaceable with respect to a centerline of the medium entering the first turning element; and sensing a first lateral edge of the medium entering the first turning element and a second lateral edge exiting the second turning element; and controlling said step of arranging the crossing point to maintain alignment of said first and second lateral edge.

* * * * *